US009420871B2

(12) United States Patent
Roberts

(10) Patent No.: US 9,420,871 B2
(45) Date of Patent: Aug. 23, 2016

(54) MODULAR BACKPACK

(71) Applicant: Origin BJJ, LLC, Industry, ME (US)

(72) Inventor: Peter M. Roberts, Industry, ME (US)

(73) Assignee: Origin BJJ, LLC, Industry, ME (US)

( * ) Notice: Subject to any disclaimer, the term of this patent is extended or adjusted under 35 U.S.C. 154(b) by 5 days.

(21) Appl. No.: 14/283,259

(22) Filed: May 21, 2014

(65) Prior Publication Data

US 2015/0129627 A1 May 14, 2015

Related U.S. Application Data

(63) Continuation-in-part of application No. 29/472,470, filed on Nov. 12, 2013, now Pat. No. Des. 737,567.

(51) Int. Cl.

| | |
|---|---|
| ***A45F 3/04*** | (2006.01) |
| ***A45C 7/00*** | (2006.01) |
| ***A45C 13/10*** | (2006.01) |
| ***A45F 3/02*** | (2006.01) |

(52) U.S. Cl.

CPC ..... *A45F 3/04* (2013.01); *A45C 7/0086* (2013.01); *A45C 13/1092* (2013.01); *A45F 3/02* (2013.01); *A45F 2003/045* (2013.01)

(58) Field of Classification Search

CPC ..... A45F 3/047; A45F 3/04; A45F 2003/045; A45F 2003/025

USPC ..... 224/581–583, 579

See application file for complete search history.

(56) References Cited

U.S. PATENT DOCUMENTS

| | | | | |
|---|---|---|---|---|
| 2,620,479 | A | | 12/1952 | Buck |
| 2,982,105 | A | | 5/1961 | Akers |
| 3,061,057 | A | | 10/1962 | Miller |
| 3,122,225 | A | | 2/1964 | Ward |
| 3,357,613 | A | | 12/1967 | Chase |
| 3,443,671 | A | | 5/1969 | Dyke |
| 3,831,651 | A | | 8/1974 | Leahy |
| 4,018,369 | A | | 4/1977 | Jaeger |
| 4,081,061 | A | | 3/1978 | Tucker |
| 4,236,657 | A | | 12/1980 | Brunton |
| 4,318,502 | A | | 3/1982 | Lowe et al. |
| 4,491,258 | A | | 1/1985 | Jones |
| 4,778,091 | A | | 10/1988 | Barto |
| 4,793,534 | A | | 12/1988 | Berry |
| 5,014,359 | A | | 5/1991 | Hanson |
| 5,050,998 | A | | 9/1991 | Wachtel |
| 5,184,763 | A | | 2/1993 | Blaisdell et al. |
| 5,240,159 | A | * | 8/1993 | Gregory ..... A45F 3/04 224/264 |
| 5,249,890 | A | | 10/1993 | Bergstrom |
| 5,292,044 | A | | 3/1994 | Reimers |
| D352,165 | S | | 11/1994 | Covertson |

(Continued)

OTHER PUBLICATIONS

USPTO, Office Action, U.S. Appl. No. 29/472,470, dated Apr. 22, 2015, pp. 1-14.

*Primary Examiner* — Adam Waggenspack

(74) *Attorney, Agent, or Firm* — Dennis R. Haszko

(57) ABSTRACT

An apparatus forming a modular backpack with two compartments where one is larger than the other. The two compartments may be utilized together or independently. Three straps are provided which may be utilized together with one or both of the two compartments. Two of the straps serve as shoulder straps and the third as a waistband by the user. The straps may be used in various configurations by the user with one or more straps being used at a time, likewise with one or both compartments.

20 Claims, 15 Drawing Sheets

(56) References Cited

U.S. PATENT DOCUMENTS

| | | | | |
|---|---|---|---|---|
| 5,361,955 | A | 11/1994 | Gregory | |
| 5,564,612 | A | 10/1996 | Gregory | |
| 5,634,579 | A | 6/1997 | Baclawski | |
| 5,639,005 | A | 6/1997 | Chouinard | |
| 5,704,528 | A | 1/1998 | Faure | |
| 5,743,447 | A * | 4/1998 | McDermott | A45C 7/0068 224/153 |
| 5,934,527 | A | 8/1999 | Von Neumann | |
| 6,189,750 | B1 | 2/2001 | Von Neumann | |
| 6,422,439 | B1 * | 7/2002 | Kelliher | A45F 3/16 190/110 |
| 6,460,746 | B1 * | 10/2002 | Amram | A45F 3/047 224/579 |
| 6,837,409 | B2 | 1/2005 | Lemanski, II | |
| D642,791 | S | 8/2011 | Quehl | |
| D665,573 | S | 8/2012 | Crandall | |
| 8,534,523 | B2 | 9/2013 | Murdoch et al. | |
| D699,431 | S | 2/2014 | Hock | |
| 8,960,511 | B2 * | 2/2015 | Shepherd | A45C 3/00 224/259 |
| 2002/0185508 | A1 | 12/2002 | Clark et al. | |
| 2004/0060954 | A1 * | 4/2004 | Hale | A45F 3/08 224/581 |
| 2008/0156835 | A1 * | 7/2008 | Schlipper | A45F 3/04 224/264 |
| 2009/0127299 | A1 * | 5/2009 | Jamlang | A45F 4/02 224/153 |
| 2010/0213892 | A1 | 8/2010 | Desanctis | |
| 2010/0237110 | A1 | 9/2010 | Hunter | |
| 2010/0243692 | A1 | 9/2010 | Sabbah | |

* cited by examiner

MODULAR BACKPACK

CROSS REFERENCE TO RELATED APPLICATIONS

This application is a continuation-in-part from and claims the benefit of priority of U.S. Design patent application Ser. No. 29/472,470 filed 12 Nov. 2013, which is incorporated herein by reference.

FIELD OF THE INVENTION

The present invention relates generally to modular backpacks. More particularly, the present invention relates to a reconfigurable backpack with two main compartments usable together or independently upon an individual via one or both cross straps.

BACKGROUND OF THE INVENTION

In the history of wearable carrying devices, there have been many different types of backpacks. Some such backpacks are modular in nature such that they can be altered by the user in the manner they are worn upon the user's body. Others are reconfigurable to provide one or more compartments that can be added or removed by the user.

One such known modular backpack is shown by Berry in U.S. Pat. No. 4,793,534 issued on 27 Dec. 1998. The device of Berry is a basic configuration that includes two sash-like side bags worn in a crisscrossing manner upon a user. Front mounted and rear mounted bags can be clipped to the crossed side bags depending upon the carrying requirements of the user. While functional, this relatively cumbersome configuration can be bulky and requires multiple components for front and/or rear bags to even be usable.

Another such modular backpack is shown by Gregory in U.S. Pat. No. 5,361,955 issued on 8 Nov. 1994. The device of Gregory represents a contemporary style of hiking backpack for carrying heavy loads over substantial periods of time includes a back panel with a polyfoam layer, a stretch fabric cover, and a fabric layer between the polyfoam layer and the back panel, all thermally molded to the back panel to define a number of smaller polyfoam pads. A carry bag is attached to the back panel with a separate waist support having separate molded left and right waistband pads fastened thereto. A molded bun pad of multilayered polyfoam is positioned between the waistband pads and stitched to the lower part of the back panel and to a bottom panel of the carry bag, leaving a space between itself and the back panel to insert and remove the waist support and waistband pads. A pair of generally triangular stress panels are stitched to the lower part of the back panel on each side so as to overlay the outside of the waistband pads and padded shoulder straps are attached to the stress panels and to the upper part of the back panel. Although this device offers some modularity in terms of removable waistband and adjustability with regard to a variety of straps and buckles, there is little if any variation available in the manner in which the user wears this type of backpack.

Yet another such modular backpack is shown by Chouinard in U.S. Pat. No. 5,639,005 issued on 17 Jun. 1997. The device of Chouinard is a utility vest system that includes a front portion of a utility vest designed to accommodate the needs of a particular sporting activity. The front portion of the utility vest further includes a pair of buckles at the top of the utility vest near the shoulders of a wearer and a buckle on either side of the vest near the waist of a wearer. A backpack designed for use with the utility vest front portion includes complementary buckles on the tops of the shoulder straps for attaching the top buckles on the utility vest front portion. The backpack further includes complementary buckles on the lower sides of the backpack for attaching the side buckles on the utility vest front portion. If a user wishes to use the utility vest without the backpack, there is a webbing harness that comprises two pieces of webbing sewed in an "X" configuration. The webbing harness is worn on the back of the user and includes two complementary top buckles for attaching to the top buckles on the utility vest front portion. The webbing harness also includes two complementary bottom buckles for attaching to the two side buckles on the utility vest front portion. Although useful when used together, the front vest and rear backpack sections form a relatively awkward saddlebag-like structure.

Yet still another such modular backpack is shown by Von Neumann in U.S. Pat. No. 6,189,750 issued on 20 Feb. 2001. The device of Von Neumann shows a modular backpack that has four bags or units usable connected together by zippers or snaps or the like. The bags may also be used separately or in various subcombinations. The bags comprise a main bag with shoulder straps useable as a backpack, a middle bag connectable to the bottom of the main bag, and a lower bag connectable to the bottom of the middle bag or directly to the bottom of the main bag. The middle bag may be used alone or together with a lower bag as a waist bag. A purse is removably attached to the main bag. While this device is able to be arranged into a variety of configurations, this design suffers from a lack of ergonomic strap arrangements.

It is, therefore, desirable to provide a modular backpack that can be quickly and easily reconfigured among a variety of useful and ergonomic arrangements.

SUMMARY OF THE INVENTION

It is an object of the present invention to obviate or mitigate at least one disadvantage of previous modular backpacks.

In a first aspect, the present invention provides a modular backpack including: a first compartment having a first primary clasp and a second primary clasp located at a top left position of the first compartment, a third primary clasp and a fourth primary clasp located at a top right position of the first compartment, a first secondary clasp and a second secondary clasp located at a bottom left position of the first compartment, a third secondary clasp and fourth secondary clasp located at a bottom right position of the first compartment; a second compartment having a fifth primary clasp located at a top left position of the second compartment, a sixth primary clasp located at a top right position of the second compartment, a fifth secondary clasp located at a bottom left position of the second compartment, a sixth secondary clasp located at a bottom right position of the second compartment; and at least one load bearing strap connectable between certain ones of the primary clasps and the secondary clasps on either the first compartment or the second compartment.

In a further embodiment, one or more of the load bearing straps are connected between selectively changeable primary clasps and secondary clasps in a variety of overall configurations.

In further aspect, the present invention provides the first compartment connected to the second compartment by way of the primary and secondary clasps.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides an apparatus that forms a modular backpack. The apparatus includes two compartments with one larger than the other. The two compartments are designed in such a manner that they may be utilized together or independently. Moreover, three straps are provided which may be utilized together with one or both of the two compartments. Still further, two of the straps are designed to be utilized as shoulder straps by the user. Yet still further, the two straps may be used in various configurations by the user with one or both straps being used at a time, likewise with one or both compartments. These features of the present invention are now discussed in further detail herein below.

Figure 1:
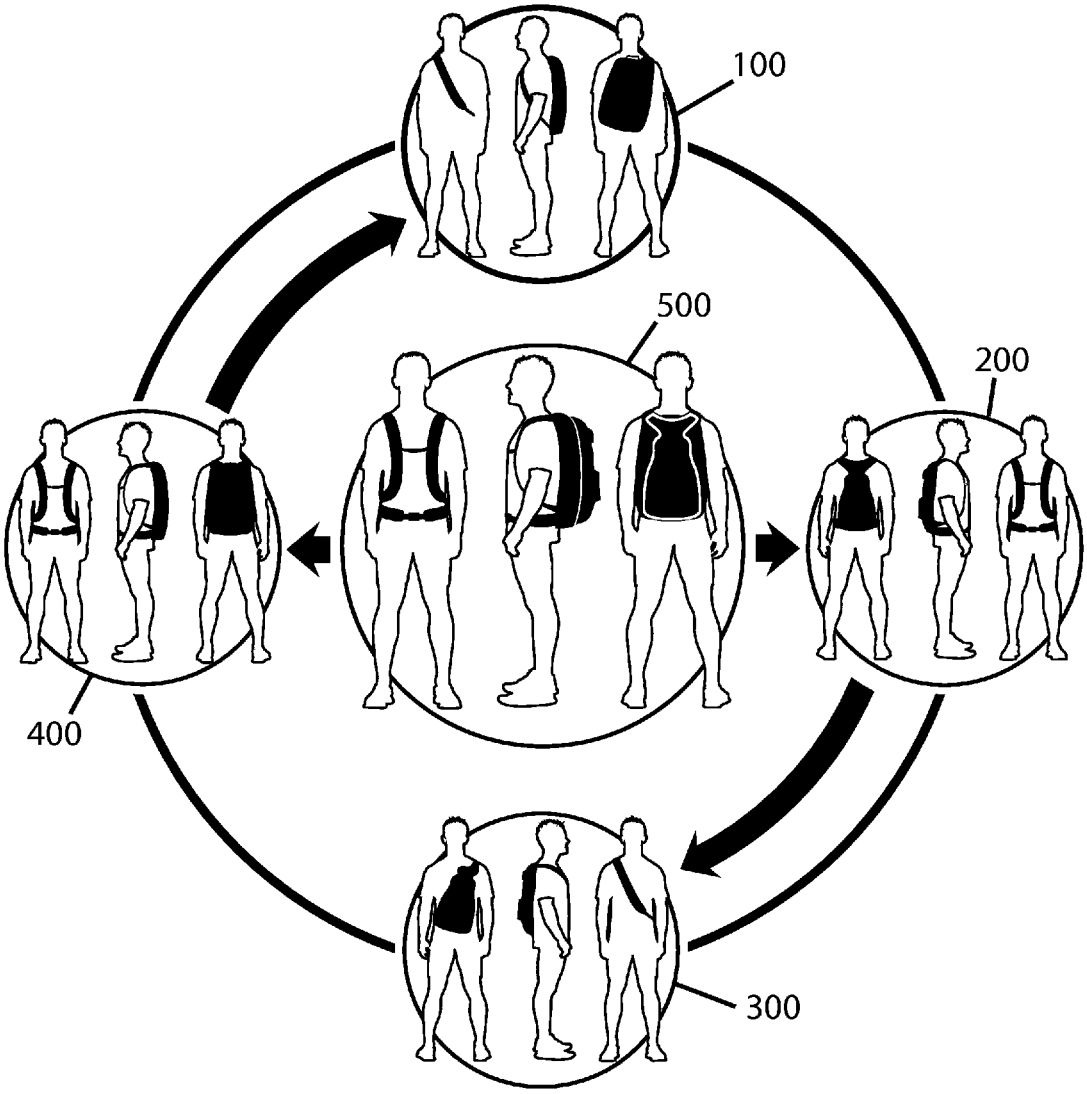
FIG. 1 is an illustration showing the range of various configurations of the modular backpack in accordance with a preferred embodiment of the present invention.

With reference to FIG. 1, the present invention is illustrated in terms of a range of configurations. A user is shown in silhouette in a frontal, side, and rear position within each particular configuration. The most complete configuration 500 shows a user with a full configuration of the present invention strapped to the user. By full configuration, what is meant is that both the large and small compartments and all three straps are utilized together. This full configuration differs from the sash configurations 100 and 300. By sash configuration, what is meant is that only one strap is utilized in a sash-like manner across the chest of the user with either only the large compartment or only the small compartment as shown, respectively, in 100 and 300. Likewise, the full configuration shown as 500 can be reconfigured using only the large compartment or only the small compartment as shown, respectively, in 400 and 200. The compartments and straps will now be described in more detail with regard to the remaining figures.

Figure 2:
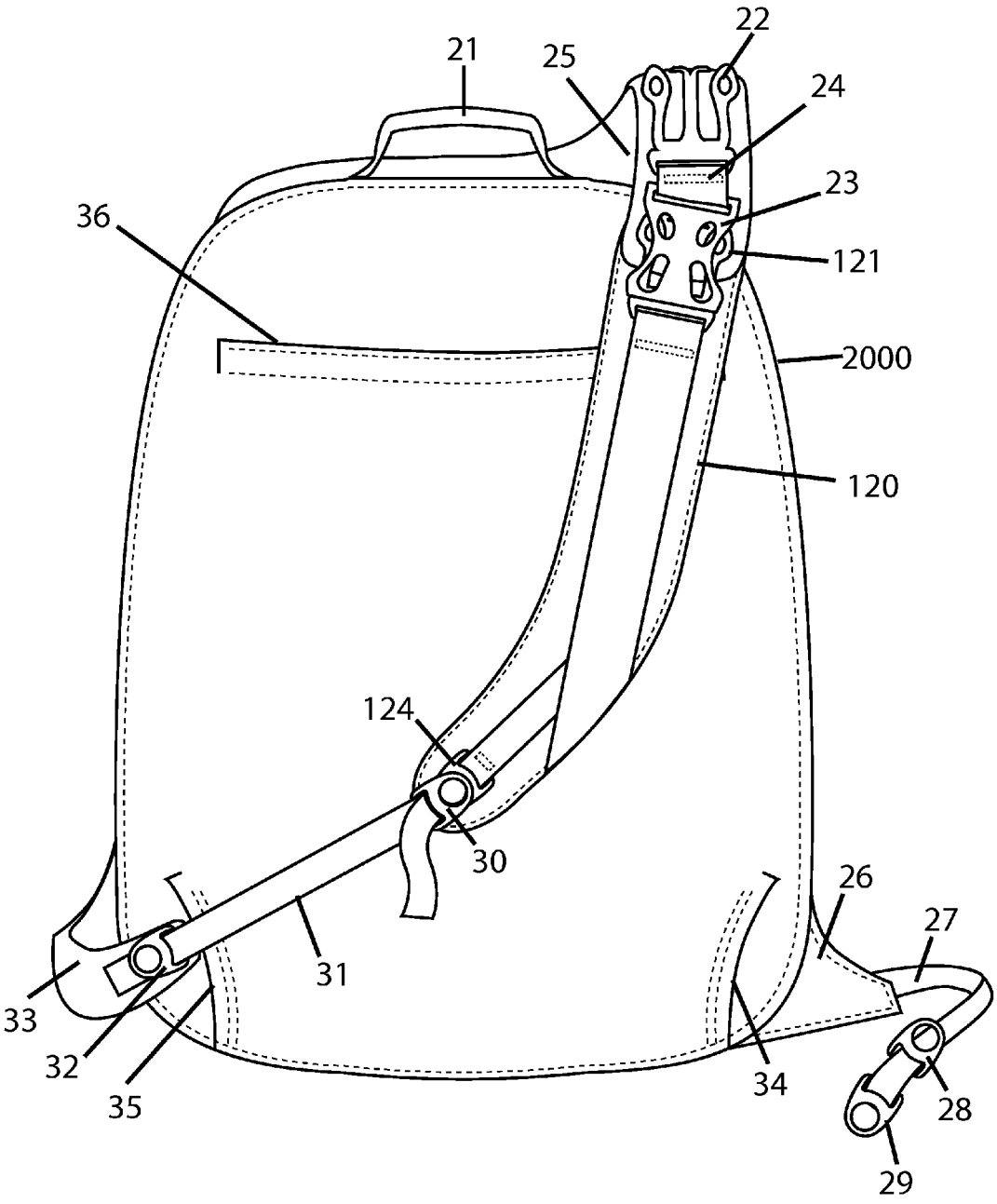
FIG. 2 is a forward facing view of a single-strap configuration of the large compartment of the present invention without insertion of a waist band.
Figure 3:
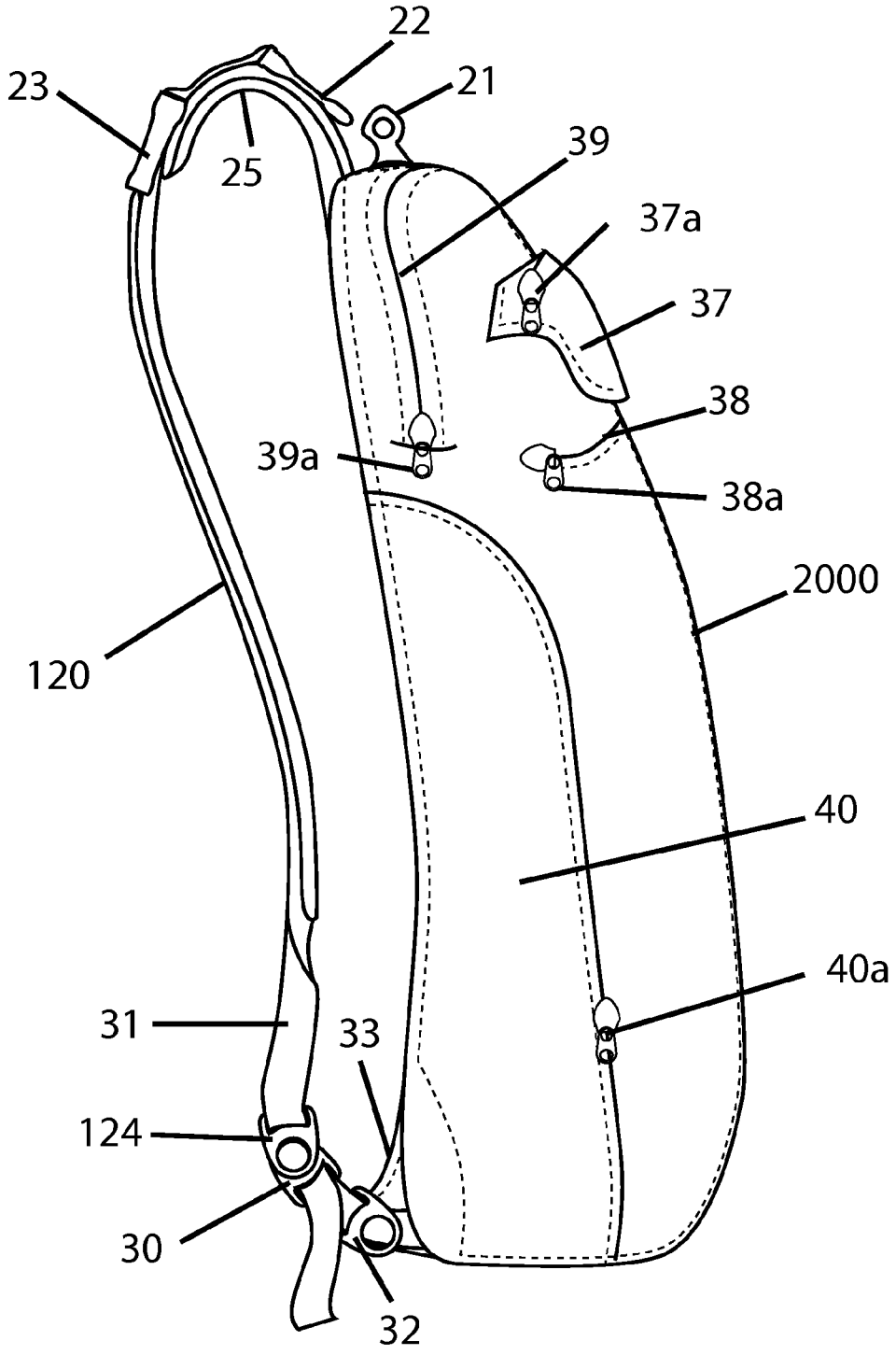
FIG. 3 is a side facing view of the single-strap configuration shown in FIG. 2.

The sash configuration utilizing a large compartment is illustrated in detail with regard to FIGS. 2 and 3. FIG. 2 is a forward facing view of the single-strap 120, sash configuration with a large compartment 2000. Here, no waist band strap is utilized so as to allow a user to sling the large compartment 2000 over one shoulder. This typically results in slightly off-center positioning upon the user's torso whereby a waist band strap would not be beneficial. FIG. 3 is simply a side facing view of the single-strap configuration shown in FIG. 2. Together, these figures correspond to a single strap sash configuration such as that shown at 100 in FIG. 1.

As mentioned, the arrangement shown in FIGS. 2 and 3 include the large compartment 2000 and one strap 120. The strap 120 is connectable in a quick and easily removable manner from the compartment 2000 by way of connectors 121 and 124. The connectors shown are two specific type of quick release mechanisms well known in the art of fasteners. In particular, connector 121 is a non-rotatable male clasp insertable into the corresponding female clasp 23 which itself is adhered (see stitching 24) to a shoulder tab 25 formed on the top of the compartment 2000. As well, connector 124 is a slightly different rotatable type of male clasp insertable into the corresponding female clasp 30.

It should be understood that while various types of connectors may be used for the elements 23, 121, 124, and 30 without straying from the intended scope of the present invention, the basic function of the top-most elements 23, 121 is to form a strong (i.e., in terms of high weight bearing capacity), yet quickly releasable and non-rotatable connection of the strap and compartment whereas the basic function of the bottom-most elements 30, 124 is to form a less strong, yet quickly releasable and rotatable connection of the strap and compartment. In this manner, the top-most connection bears most weight carrying capacity in a generally linear direction. However, the bottom-most connection is rotatable to allow for swaying of the backpack (in any configuration) while in use. As well, the bottom-most connection does not require as robust a connector element as the vast majority of load is upon the top-most connection rather than the bottom-most connection.

With continued reference to FIGS. 2 and 3, there are a variety of additional items shown. These include a pocket 36 which may be provided for storage of any number of things by the user including, but not limited to, stowage of strap(s) not in current use (i.e., removed). A handle 21 may be provided as shown which is useful when the compartment 2000 is removed from the worn position upon the user. In such instance, both straps may be stowed, for example, in pocket 36. It should be readily apparent that pockets of any shape or size may be provided within or upon the compartment 2000. Indeed, a variety of pockets are shown in the side view of FIG. 3 including pockets 37, 38, 39, and 40 shown with corresponding zippers 37*a*, 38*a*, 39*a*, and 40*a*.

Similar to shoulder tab 25, there are also shown hip tabs 26 and 33. It should be understood that in FIGS. 2 and 3, there are actually two shoulder tabs, yet only one is visible in this configuration as the hidden one would be folded out of view. Later figures described herein below reveal all such shoulder and hip tabs. The function of each tab is of course to distribute load forces adequately and ergonomically so as to avoid both excessive wear in the back pack as a whole and reducing fatiguing of the user.

Hip retention straps 27 and 31 are shown and are sewn or otherwise permanently affixed to their corresponding hip tabs 26 and 33. As shown, hip retention strap 31 serves of course to connect the strap 120 to the hip tab 33, but also provide adjustability in terms of lengthening or shortening by pulling the loose end of hip retention strap 31 through connector 30. Thus, the user may customize their wearing experience in accordance with their torso size and preference for swaying movement of the worn backpack.

Not shown in the configuration of FIGS. 2 and 3 is the waistband. However, the location of insertion of the waistband in accordance with the present invention can be seen by way of pocket openings 34 and 35. These openings provide access to a contiguous internal cavity through which the waistband may be inserted in a removable manner. This aspect is described here below in more detail.

As shown, hip retention straps 27 and 31 each also include corresponding connector elements 28 and 32. These connector elements 28 and 32 are not used in the single strap sash configuration of the inventive backpack. Rather, connector elements 28 and 32 are used in the full configuration which is described here below in more detail.

Figure 4:
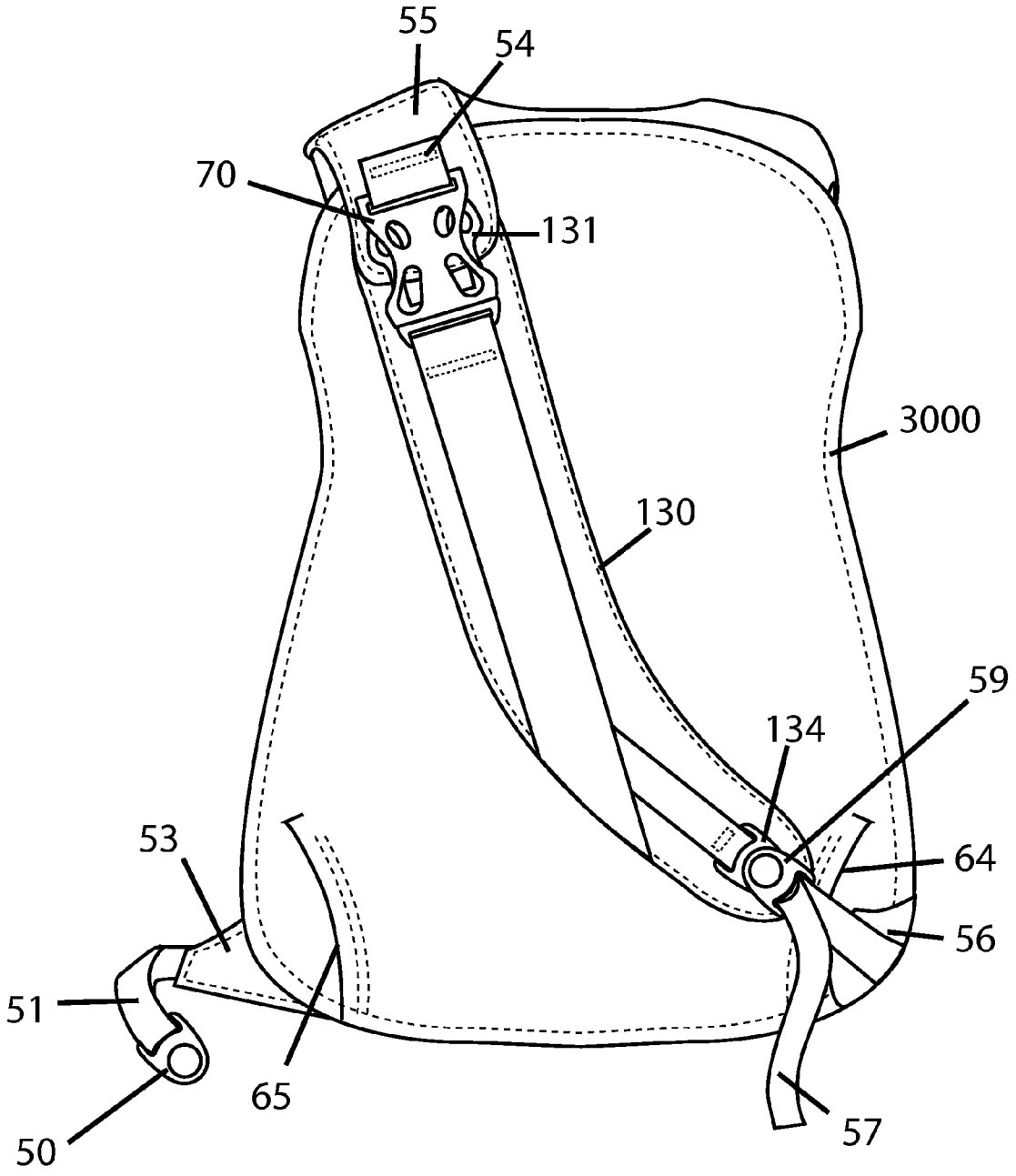
FIG. 4 is a forward facing view of a single-strap configuration of the small compartment of the present invention without insertion of a waist band.
Figure 5:
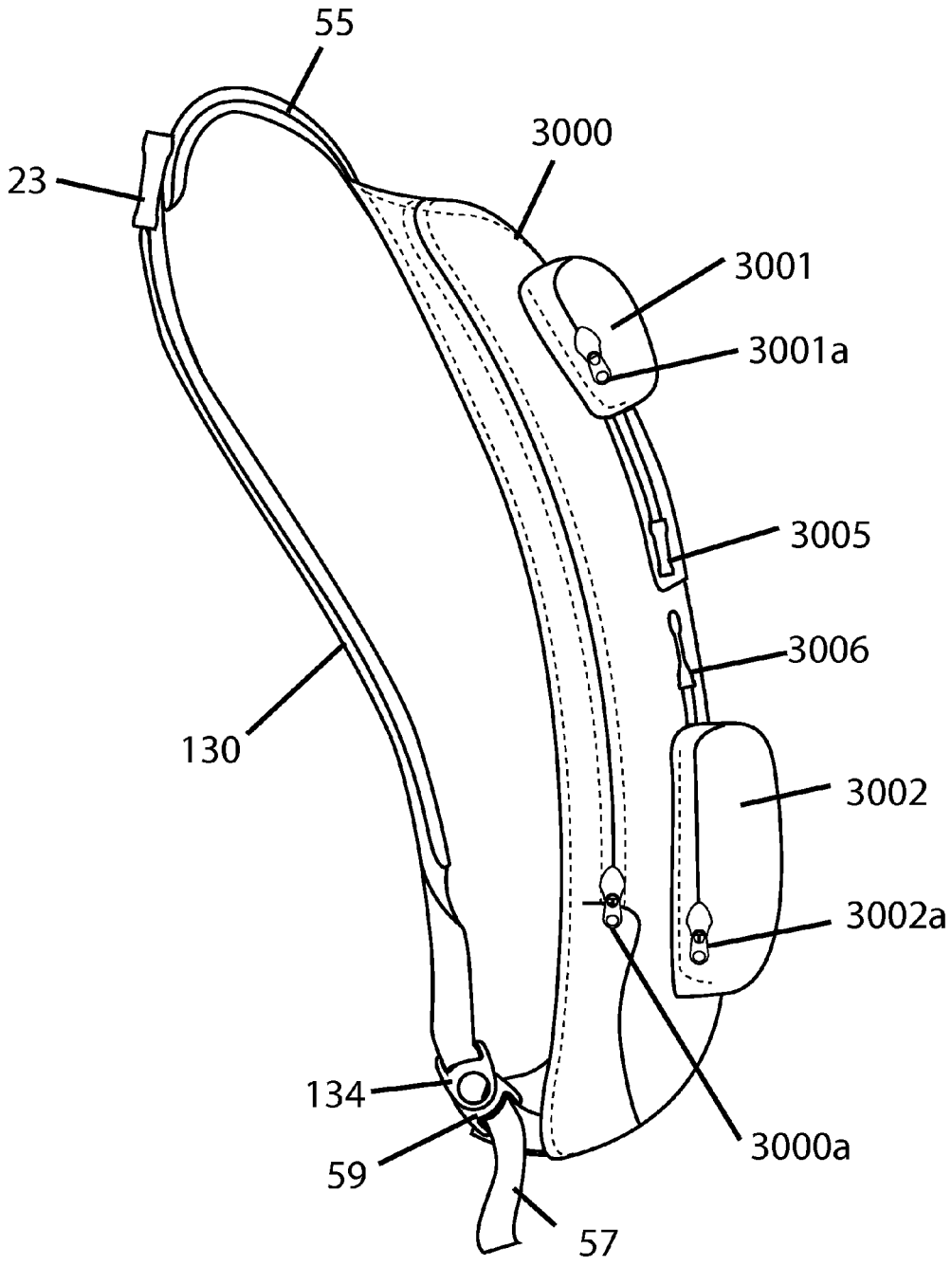
FIG. 5 is a side facing view of the single-strap configuration shown in FIG. 4.

Similar to the large compartment, single strap sash configuration, the present invention provides for a similar small compartment configuration. In particular, FIGS. 4 and 5 show a single-strap configuration of the small compartment of the present invention shown without insertion of a waist band. It should be noted that both the large compartment configuration of FIGS. 2 and 3 may coexist with the small compartment configuration of FIGS. 4 and 5. This is enabled by the strap 130 being a mirror image of strap 120. A comparison of the configuration of FIG. 2 contrasted with the configuration of FIG. 4 clearly shows that strap 120 includes oppositely angled construction relative to strap 130. This construction enables dual functionality of the straps 120 and 130 whereby they can be removed from and reassembled upon either or both of the large and small compartments 2000, 3000. In this way, the present invention becomes a modularized apparatus providing the innovative reconfigurability illustrated in FIG. 1.

The small compartment sash configuration can be described nearly identically to the large compartment sash configuration. FIG. 4 is a forward facing view of the single-strap 130, sash configuration with a small compartment 3000. Here, no waist band strap is utilized so as to allow a user to sling the small compartment 3000 over one shoulder. This typically results in slightly off-center positioning upon the user's torso whereby a waist band strap would not be beneficial. FIG. 5 is a side facing view of the single-strap configuration shown in FIG. 4. Together, these figures correspond to a single strap sash configuration such as that shown at 200 in FIG. 1.

As mentioned, the arrangement shown in FIGS. 4 and 5 include the small compartment 3000 and one strap 130. The strap 130 is connectable in a quick and easily removable manner from the compartment 3000 by way of connectors 131 and 134. The connectors shown are two specific types of quick release mechanisms well known in the art of fasteners. In particular, connector 131 is a non-rotatable male clasp insertable into the corresponding female clasp 70 which itself is adhered (see stitching 54) to a shoulder tab 55 formed on the top of the compartment 3000. As well, connector 134 is a slightly different rotatable type of male clasp insertable into the corresponding female clasp 59.

It should be understood that while various types of connector elements may without straying from the intended scope of the present invention, the basic function of the top-most elements 70, 131 is to form a strong, yet quickly releasable and non-rotatable connection of the strap and compartment whereas the basic function of the bottom-most elements 59, 134 is to form a less strong, yet quickly releasable and rotatable connection of the strap and compartment. In this manner, the top-most connection bears most weight carrying capacity in a generally linear direction. However, the bottom-most connection is rotatable to allow for swaying of the backpack (in any configuration) while in use. As well, the bottom-most connection does not require as robust a connector element as the vast majority of load is upon the top-most connection rather than the bottom-most connection.

With continued reference to FIGS. 4 and 5, there are a variety of additional items shown. Similar to shoulder tab 55, there is also shown hip tabs 53 and 56. It should be understood that in FIGS. 4 and 5, there are actually two shoulder tabs, yet only one is visible in this configuration as the hidden one would be folded out of view. Later figures described herein below reveal all such shoulder and hip tabs. The function of each tab is of course to distribute load forces adequately and ergonomically so as to avoid both excessive wear in the back pack as a whole and reducing fatiguing of the user.

Hip retention straps 51 and 57 are shown and are sewn or otherwise permanently affixed to their corresponding hip tabs 53 and 56. As shown, hip retention strap 57 serves of course to connect the strap 130 to the hip tab 56, but also provides adjustability in terms of lengthening or shortening by pulling the loose end of hip retention strap 57 through connector 59. Thus, the user may customize their wearing experience in accordance with their torso size and preference for swaying movement of the worn backpack.

Not shown in the configuration of FIGS. 4 and 5 is the waistband. However, the location of insertion of the waistband in accordance with the present invention can be seen by way of pocket openings 64 and 65. These openings provide access to a contiguous internal cavity through which the waistband may be inserted in a removable manner. This aspect is described here below in more detail.

It should be readily apparent that pockets of any shape or size may be provided within or upon the small compartment 3000. Indeed, a variety of pockets are shown in the side view of FIG. 5 including pockets 3001 and 3002 shown with corresponding zippers 3001*a* and 3002*a*. The small compartment 3000 itself includes a corresponding zipper 3000*a*. It should also be noted that the small compartment 3000 is provided with outer couplings 3005, 3006 which may be used to strap down additional user gear (e.g., rolled clothing) to the outer surface of the smaller compartment 3000. The couplings may be provided as clasps with retaining straps affixed to the outer surface. This aspect is particularly useful in the full configuration 500 of FIG. 1 whereby the small compartment is affixed atop the large compartment.

Figure 6:
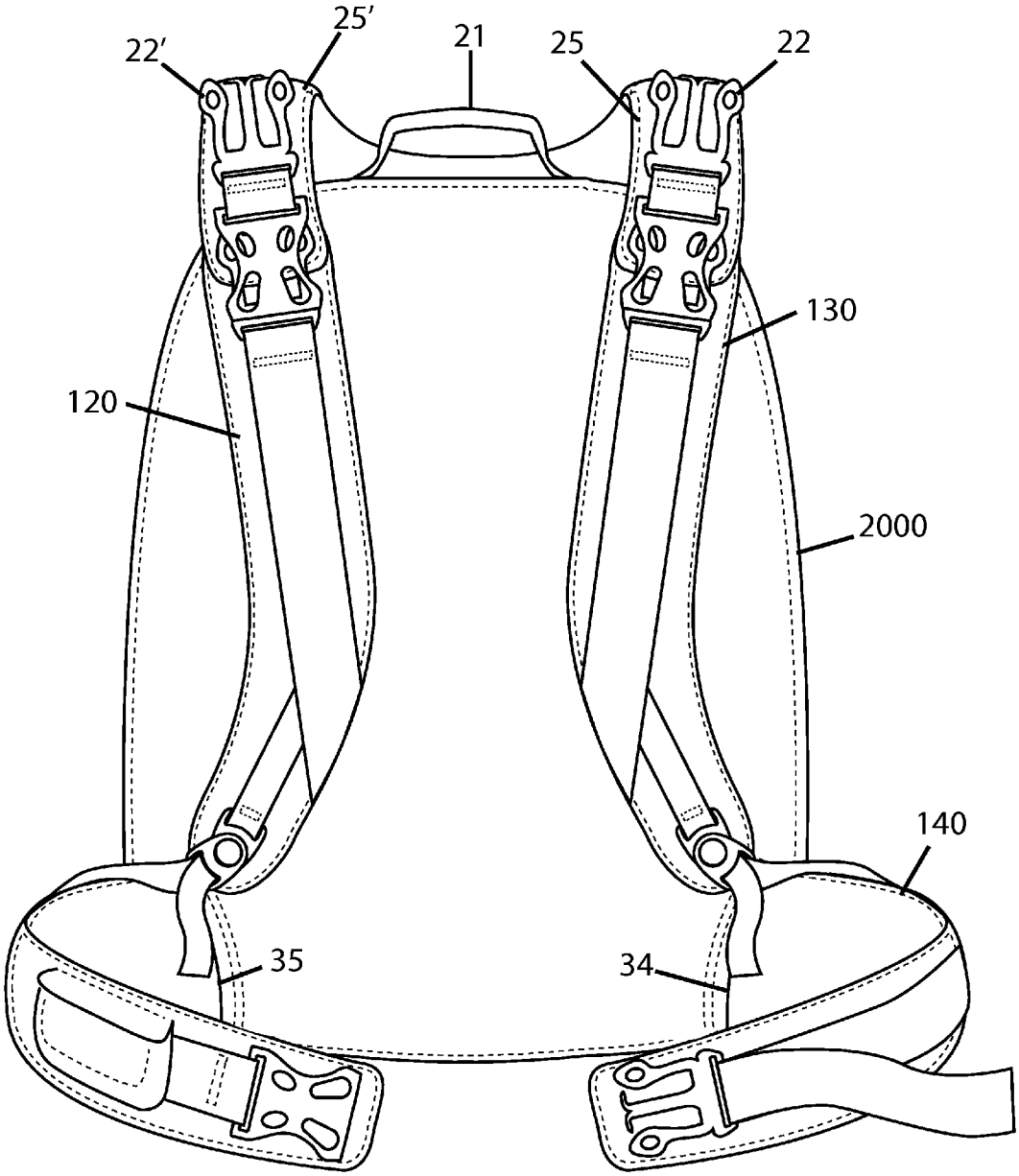
FIG. 6 is a forward facing view of a double-strap configuration of the large compartment of the present invention with insertion of a waist band.
Figure 7:
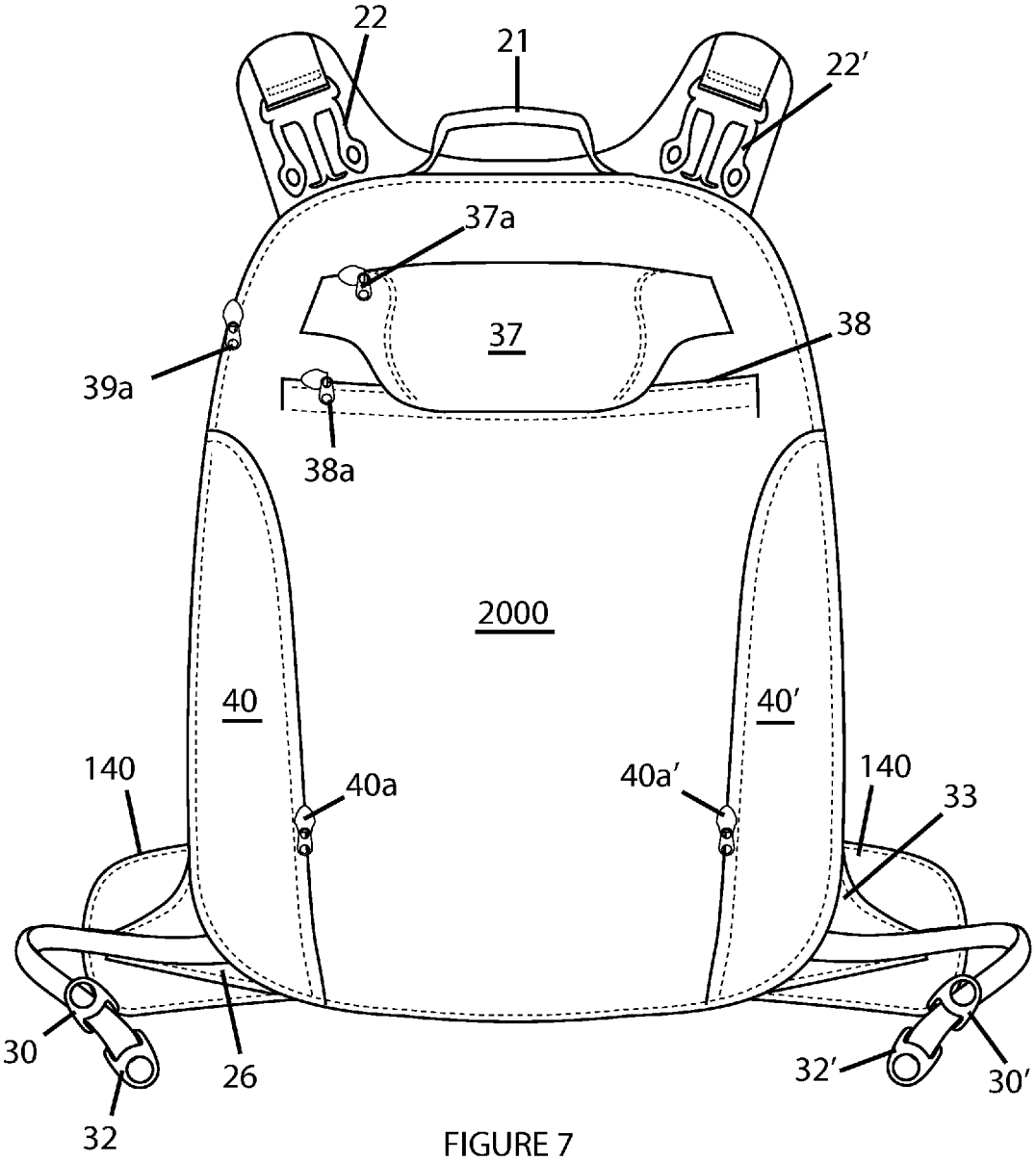
FIG. 7 is a rearward facing view of the double-strap configuration shown in FIG. 6.

With regard to FIGS. 6 and 7, there is shown the large compartment in full configuration of the present invention which utilizes all modularized strap parts of the backpack. This corresponds to configuration 400 as shown in FIG. 1. In particular, FIG. 6 is a forward facing view of a double-strap configuration of the large compartment 2000 of the present invention with insertion of a waist band 140. FIG. 7 is a rearward facing view of the double-strap configuration shown in FIG. 6. All numbered elements having been described herein above with regard to FIGS. 2 and 3 will not be discussed again. However, FIGS. 6 and 7 differ from FIGS. 2 and 3 in that both straps 120 and 130 are used together and waistband 140 in inserted into the contiguous internal cavity. It should be further noted that strap 120 (shown in transverse connection in FIG. 2) is now provided in a leftmost connection. Likewise, strap 130 (shown in a transverse connection in FIG. 4) is now shown in a rightmost connection. It should be therefore apparent that the particular innovative mechanical details of the straps 120 and 130 enables them to be used in these different positions (i.e., transverse connections vs. leftmost/rightmost connections).

Figure 8:
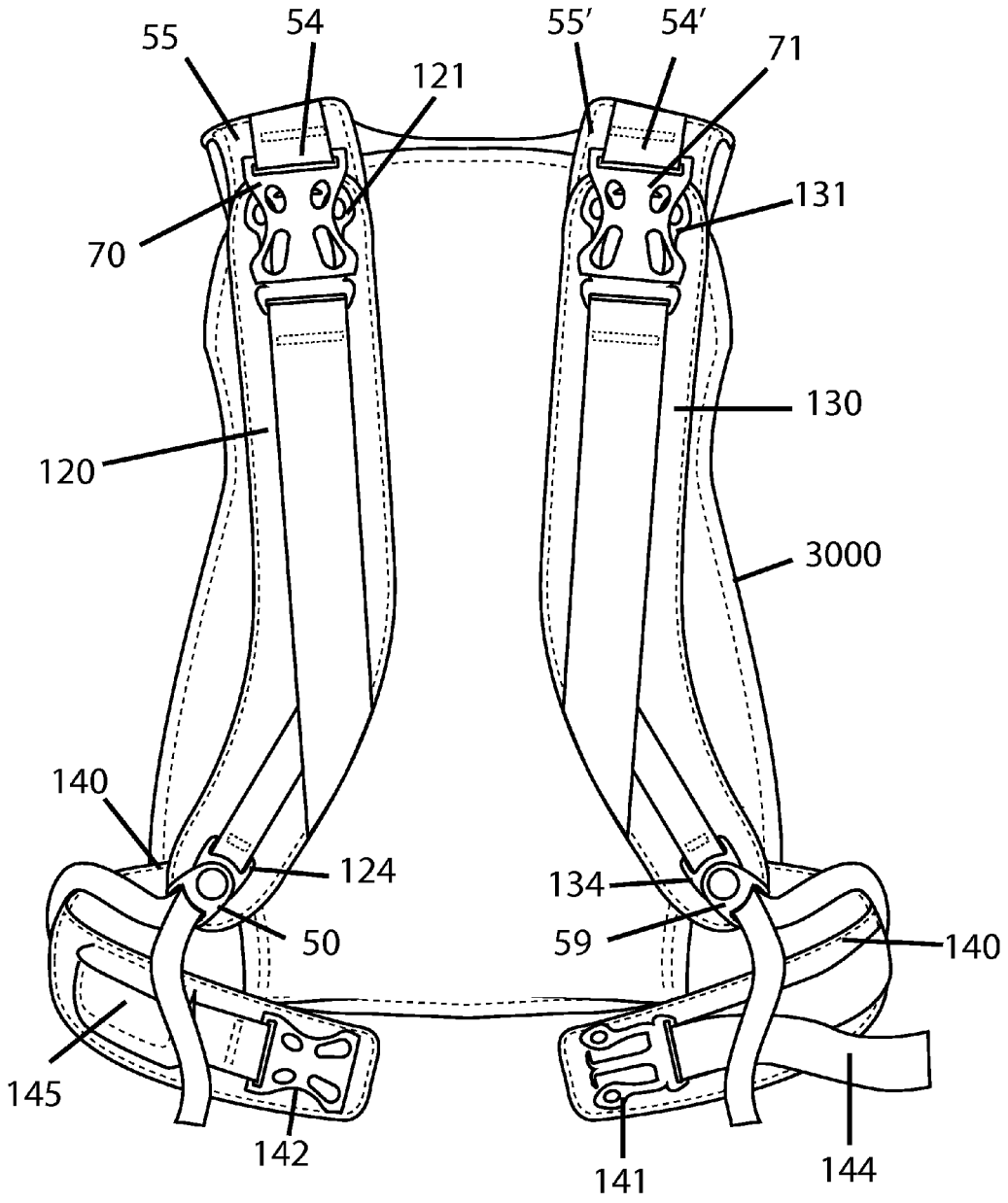
FIG. 8 is a forward facing view of a double-strap configuration of the large compartment of the present invention with insertion of a waist band.
Figure 9:
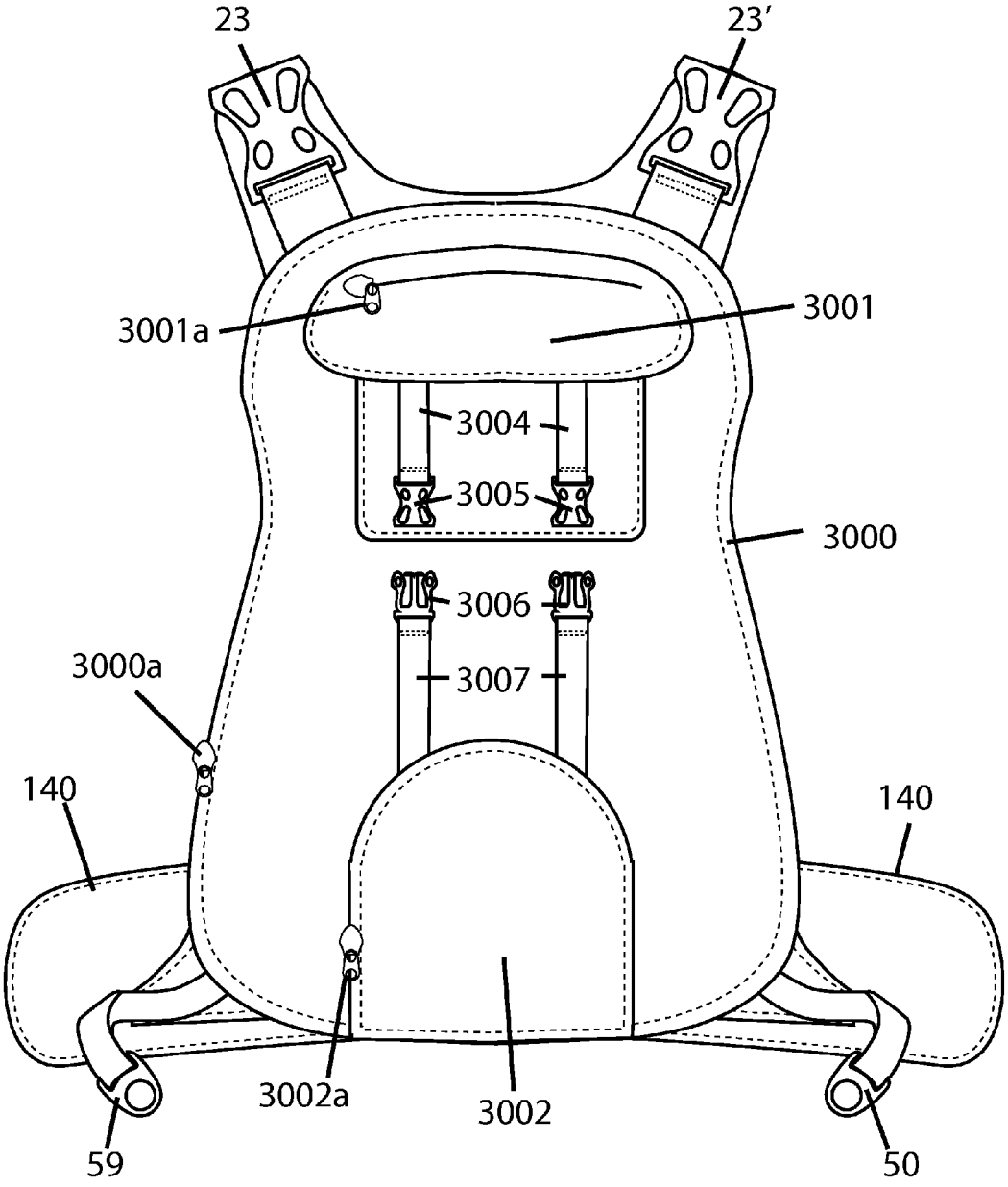
FIG. 9 is a rearward facing view of the double-strap configuration shown in FIG. 6.

With regard to FIGS. 8 and 9, there is shown the small compartment in full configuration of the present invention which utilizes all modularized strap parts of the backpack. This corresponds to configuration 200 as shown in FIG. 1. In particular, FIG. 8 is a forward facing view of a double-strap configuration of the small compartment 3000 of the present invention with insertion of a waist band 140. FIG. 9 is a rearward facing view of the double-strap configuration shown in FIG. 8. All numbered elements having been described herein above with regard to FIGS. 4 and 5 will not be discussed again. However, FIGS. 8 and 9 differ from FIGS. 4 and 5 in that both straps 120 and 130 are used together and waistband 140 is inserted into the contiguous internal cavity. It should be further noted that strap 120 (shown in transverse connection in FIG. 2) is now provided in a leftmost connection. Likewise, strap 130 (shown in a transverse connection in FIG. 4) is now shown in a rightmost connection. It should be therefore apparent that the particular innovative mechanical details of the straps 120 and 130 enables them to be used in these different positions (i.e., transverse connections vs. leftmost/rightmost connections).

With further regard to FIG. 8, the waistband will now be described. In particular, the waistband 140 may include a pouch 145 for a user to handily access stored items such as a cell phone or camera. As well, the waistband is connectable and adjustable upon a user via clasps 141 and 142 and adjustable strap 144 in a manner well known in the art. In FIG. 9, the outer couplings 3005, 3006 discussed earlier herein above are more visible and better illustrate how retaining straps 3004, 3007 may be used to strap down additional user gear (e.g., rolled clothing) to the outer surface of the smaller compartment 3000. The retaining straps 3004, 3007 may be fabricated of an elastic material.

Figure 10:
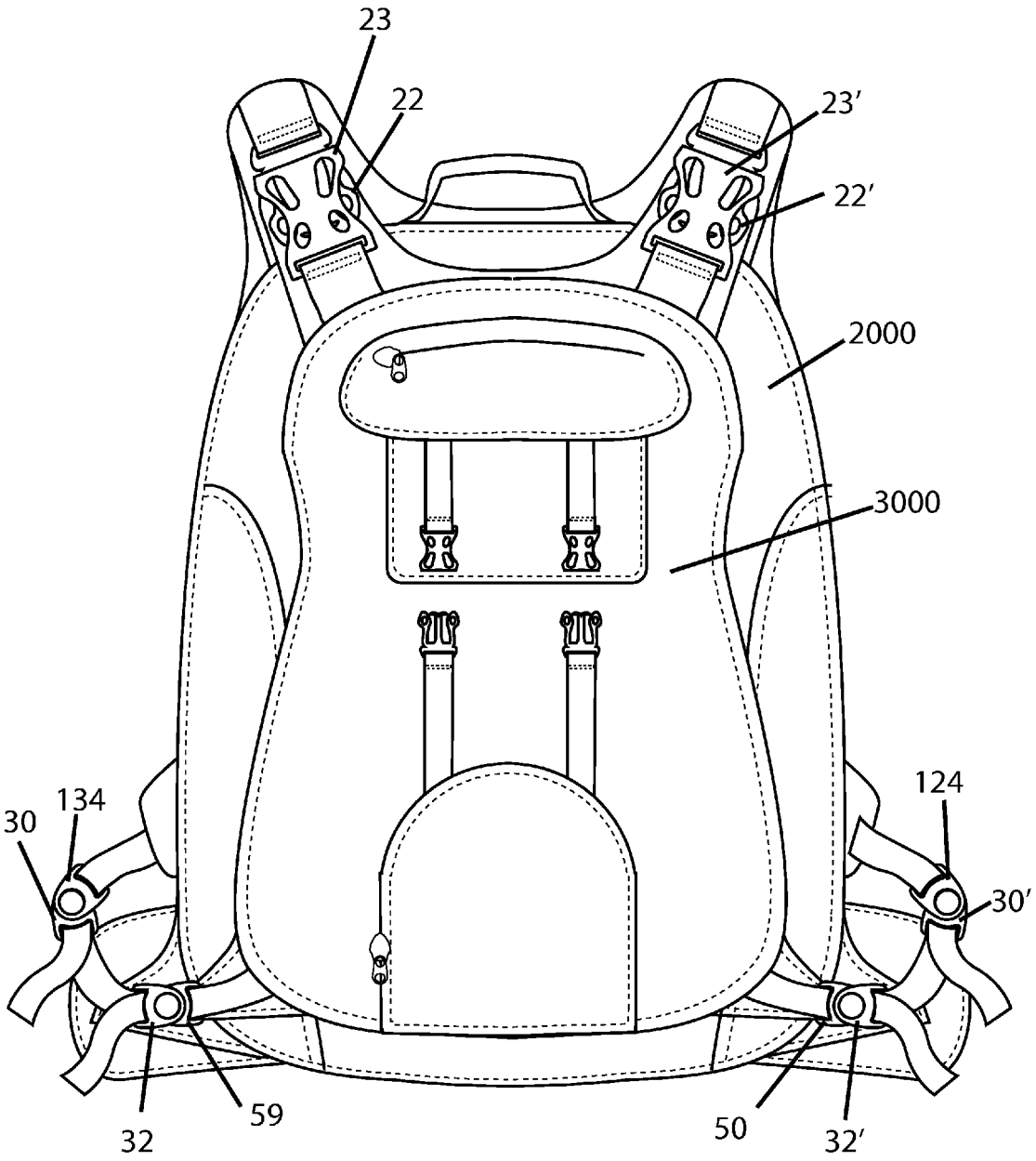
FIG. 10 is a rearward facing view of a small and large compartment combined double-strap configuration of the present invention with the waistband included.
Figure 11:
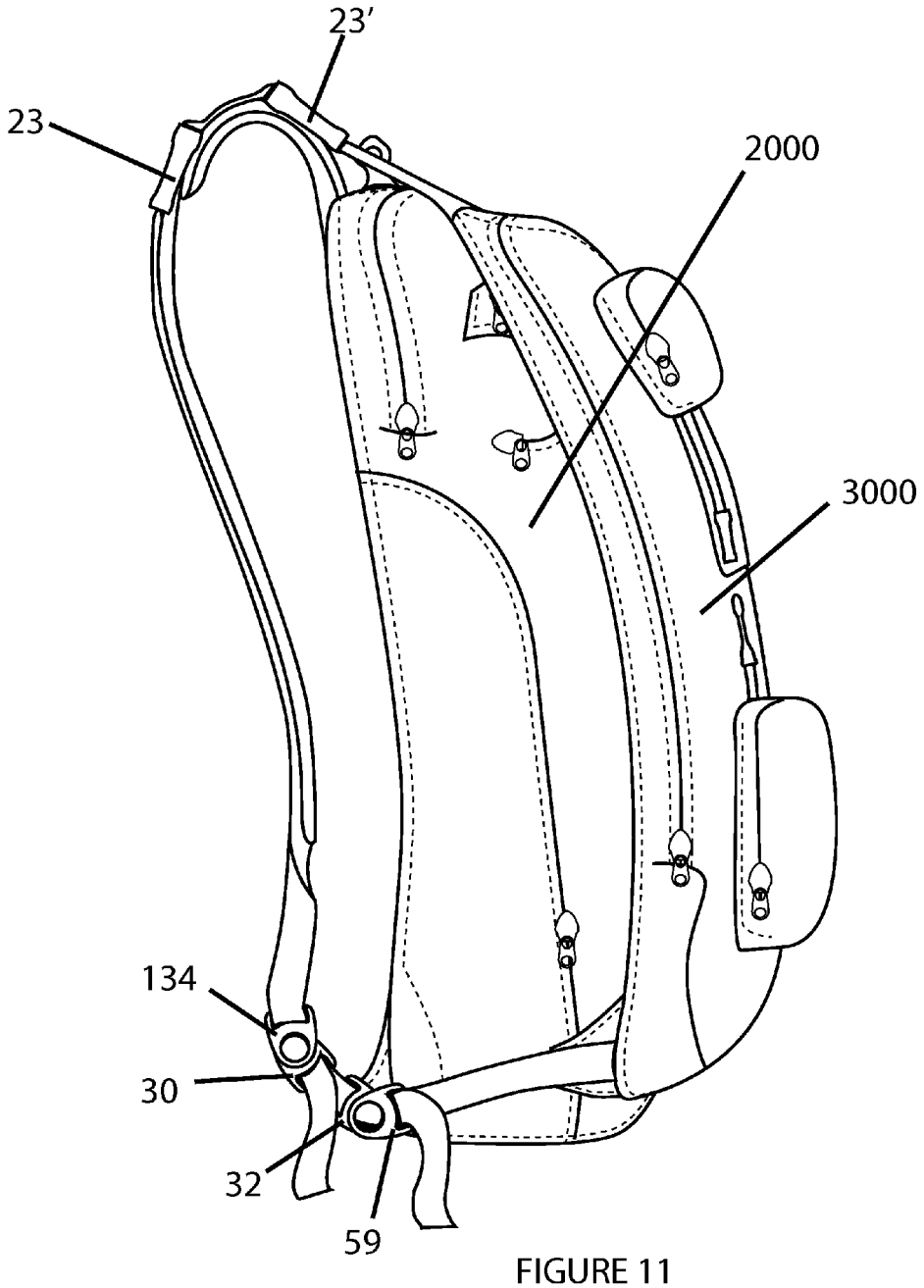
FIG. 11 is a side facing view of a small and large compartment combined double-strap configuration of the present invention without the waistband.

FIGS. 10 and 11 show the present invention with all modular parts combined together into a single apparatus. In particular, FIG. 10 is a rearward facing view of the small and large compartment combined in the full configuration (illustrated as 500 in FIG. 1) of the present invention. FIG. 11 is a side facing view of a small and large compartment combined double-strap configuration of the present invention shown however without the waistband for illustrative clarity. In terms of connecting the large compartment 2000 and small compartment 3000, a user would on one lower side utilize clasp 32 from the large compartment 2000 to attach to clasp 59 of the small compartment 3000. On the other lower side, the user would utilize clasp 32' from the large compartment 2000 to attach to clasp 50 of the small compartment 3000. Likewise, on each upper side of the backpack, clasps 22 and 22' of the large compartment 2000 would respectively connect to clasps 23 and 23' of the small compartment 3000. In this manner, the small compartment 3000 effectively piggybacks off of the large compartment 2000.

Figure 12:
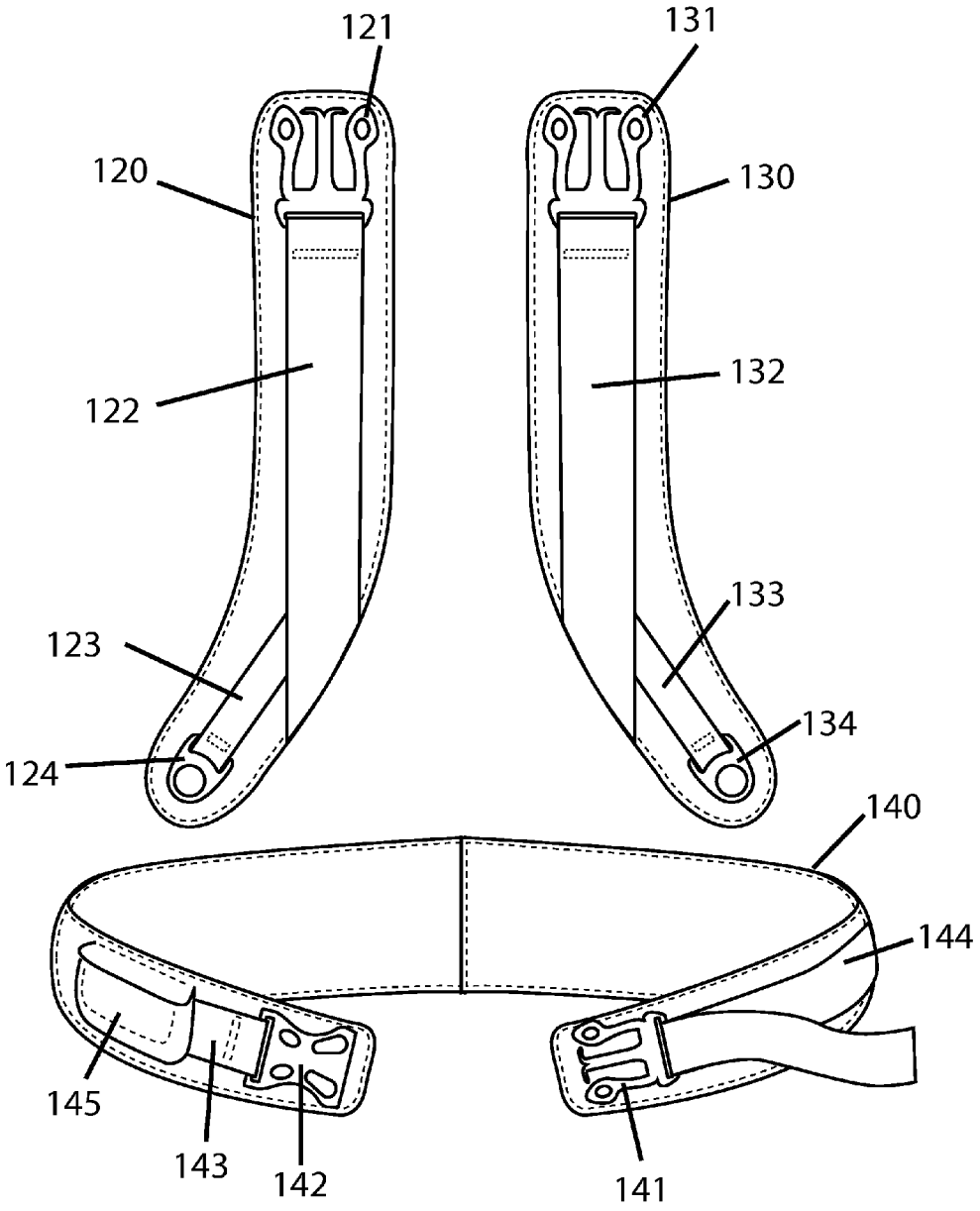
FIG. 12 shows a set of straps and waistband removed from any compartments of the present invention.

With regard to FIG. 12, the set of straps 120, 130 and waistband 140 are shown removed from any compartments of the present invention. As previously discussed, the particular mechanical details of straps 120 and 130 provide useful innovations enabling the modular reconfiguration of the backpack components. Each strap 120 and 130 include a base pad upon which are secured (by stitching or any other suitable manner) primary reinforcement strips 122, 132 and secondary reinforcement strips 123, 133. The reinforcing strips serve to distribute the carrying load when the backpack is in use. The mirror image J-shape configuration of the straps 120 and 130 enables use of the straps in either the transverse position or leftmost/rightmost positions described above. Reinforcement strips 143 and 144 are also provided in terms of the waistband 140 where the strip 144 also serves to adjust (i.e., tighten/loosen) the waistband 140 when in use upon the user.

Figure 13:
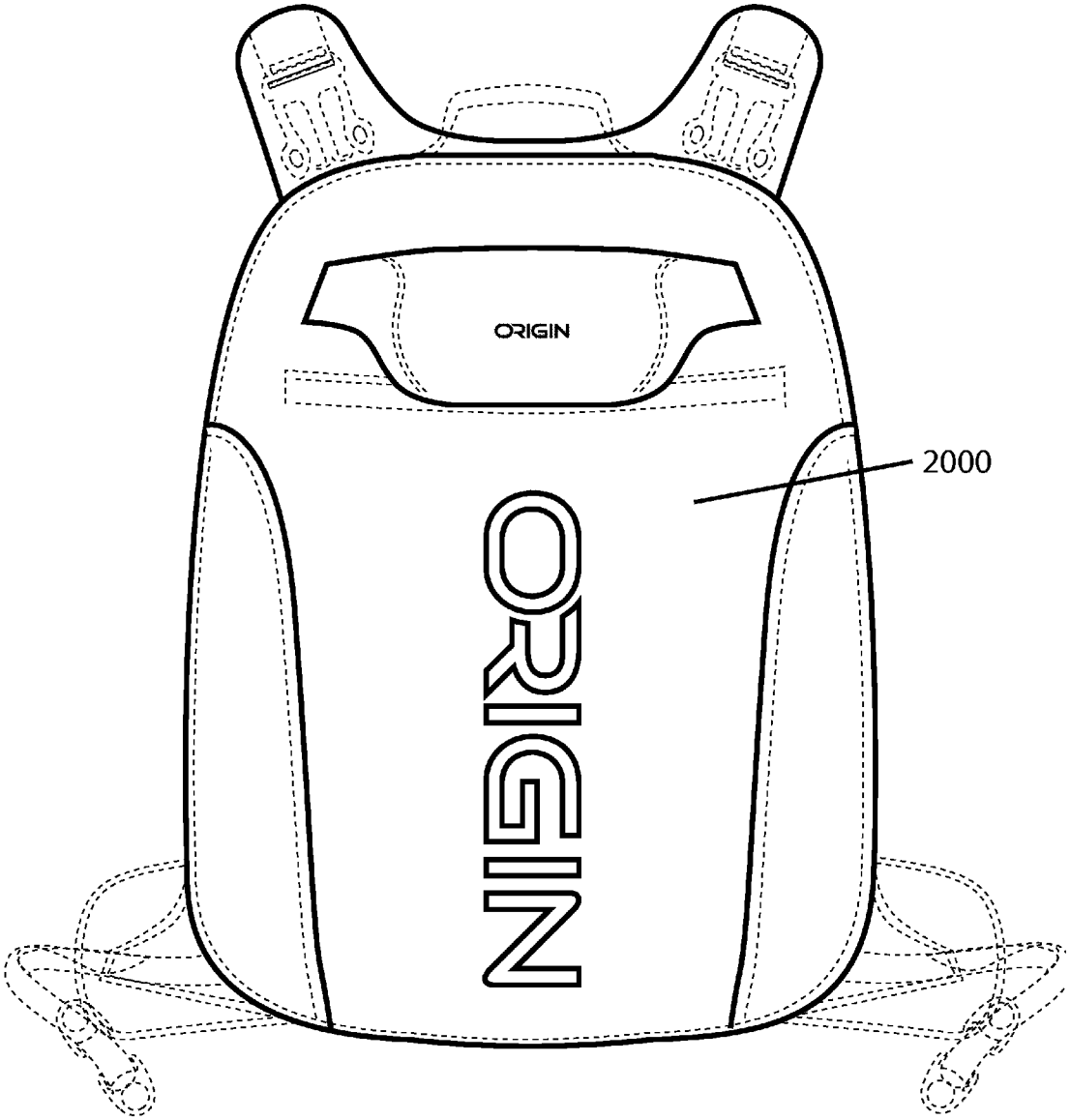
FIG. 13 shows, as a rear facing view, one possible embodiment of visual ornamentation on the large compartment of the present invention.
Figure 14:
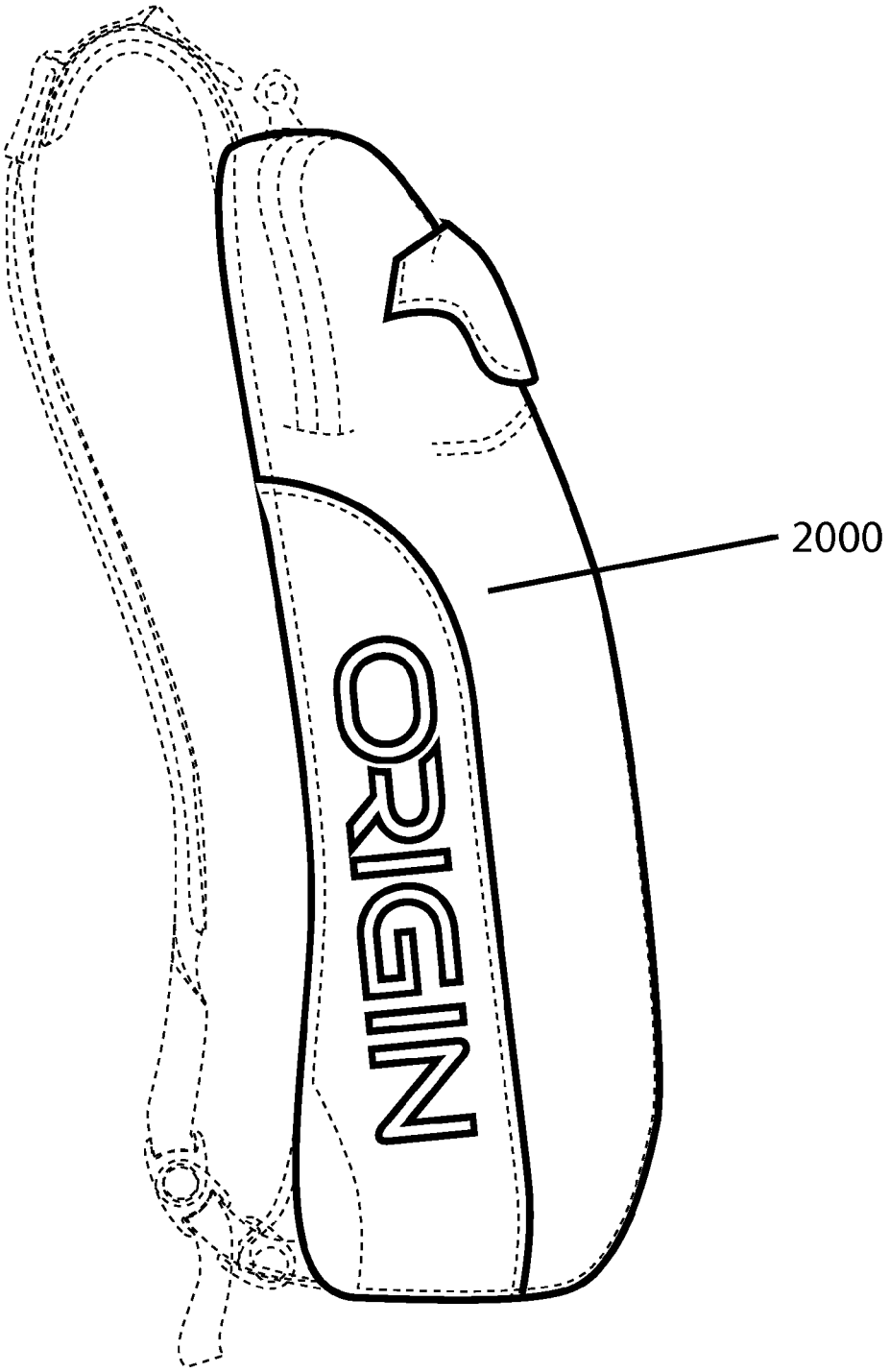
FIG. 14 shows, as a side view, one possible embodiment of visual ornamentation on the large compartment of the present invention.
Figure 15:
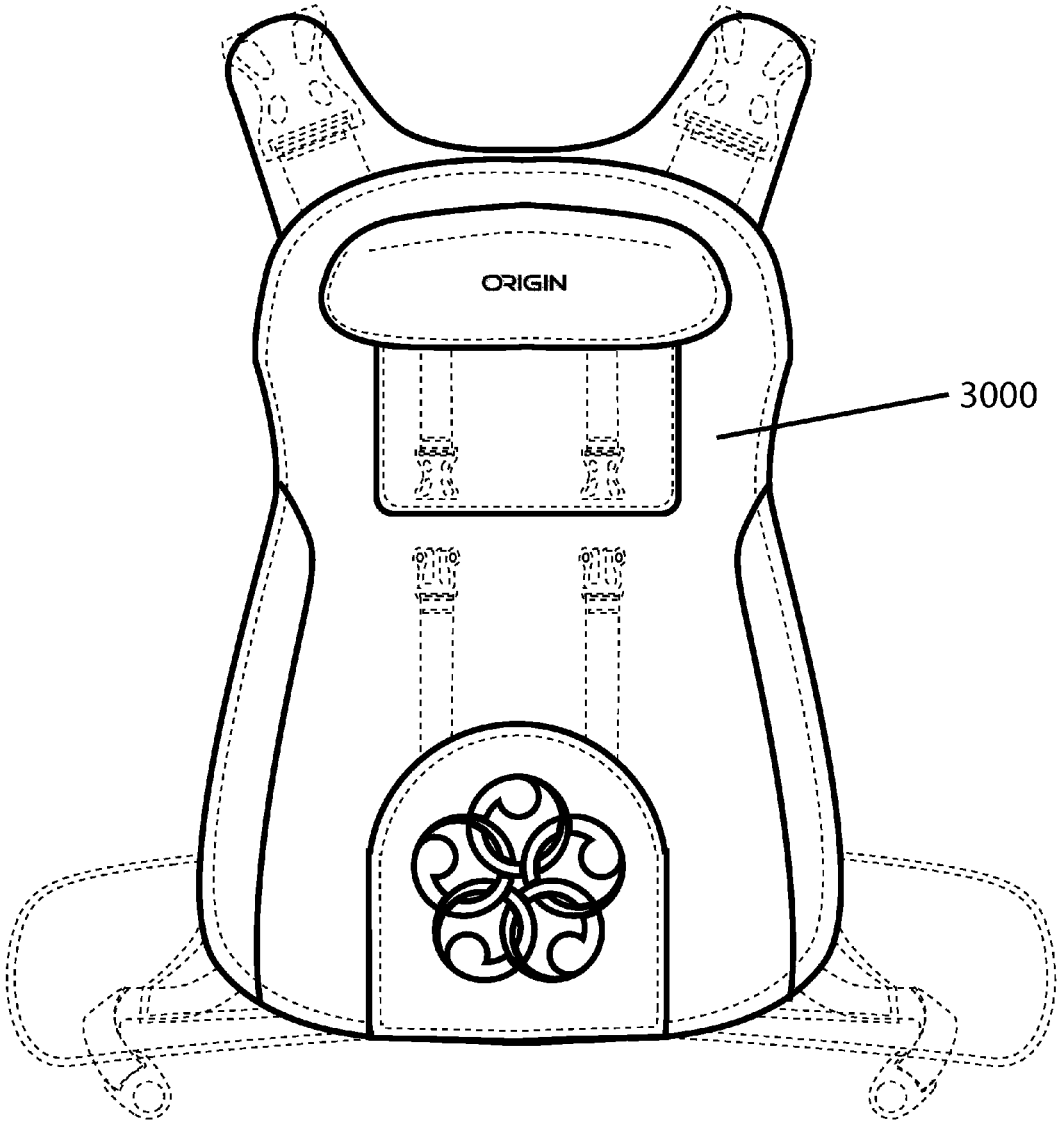
FIG. 15 shows, as a rear facing view, one possible embodiment of visual ornamentation on the small compartment of the present invention.

FIGS. 13 through 15 illustrate a variety of possible embodiments of visual ornamentations on the compartments of the present invention with non-ornamental aspects shown in silhouette for the sake of illustrative clarity. Other variations are of course possible without straying from the intended scope of the present invention.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A modular backpack comprising:

a first compartment having a first primary clasp and a second primary clasp located at a top left position of said first compartment, a third primary clasp and a fourth primary clasp located at a top right position of said first compartment, a first secondary clasp and a second secondary clasp located at a bottom left position of said first compartment, a third secondary clasp and fourth secondary clasp located at a bottom right position of said first compartment;

a second compartment having a fifth primary clasp located at a top left position of said second compartment, a sixth primary clasp located at a top right position of said second compartment, a fifth secondary clasp located at a bottom left position of said second compartment, a sixth secondary clasp located at a bottom right position of said second compartment; and a pair of load bearing straps, one said load bearing strap being a mirror image of the other, said load bearing straps connectable between certain ones of said primary clasps and said secondary clasps on either said first compartment or said second compartment, each said load bearing strap configured as curved when laid flat and including two reinforcement strips configured as straight when laid flat upon said load bearing strap, said reinforcement strips oriented at an angle to one another.

2. The modular backpack as claimed in claim 1, wherein one of said load bearing straps is connected between said fourth primary clasp and said first secondary clasp.

3. The modular backpack as claimed in claim 1, wherein one of said load bearing straps is connected between said second primary clasp and said third secondary clasp.

4. The modular backpack as claimed in claim 1, wherein one of said load bearing straps is connected between said fifth primary clasp and said sixth secondary clasp.

5. The modular backpack as claimed in claim 1, wherein one of said load bearing straps is connected between said sixth primary clasp and said fifth secondary clasp.

6. The modular backpack as claimed in claim 1, wherein two of said load bearing straps are provided such that one said load bearing strap is connected between said second primary clasp and said first secondary clasp and the other said load bearing strap is connected between said fourth primary clasp and said third secondary clasp.

7. The modular backpack as claimed in claim 6 further including a removable waistband retained in said first compartment.

8. The modular backpack as claimed in claim 1, wherein two of said load bearing straps are provided such that one said load bearing strap is connected between said fifth primary clasp and said fifth secondary clasp and the other said load bearing strap is connected between said sixth primary clasp and said sixth secondary clasp.

9. The modular backpack as claimed in claim 8 further including a removable waistband retained in said second compartment.

10. The modular backpack as claimed in claim 6 wherein said first primary clasp is connected to said fifth primary clasp, said third primary clasp is connected to said sixth primary clasp, said second secondary clasp is connected to said fifth secondary clasp, and said fourth secondary clasp is connected to said sixth secondary clasp.

11. The modular backpack as claimed in claim 10 further including a removable waistband retained in said first compartment.

12. The modular backpack as claimed in claim 1 wherein said first compartment is larger than said second compartment.

13. A modular backpack comprising:

a first compartment having a first primary clasp and a second primary clasp located at a top left position of said first compartment, a third primary clasp and a fourth primary clasp located at a top right position of said first compartment, a first secondary clasp and a second secondary clasp located at a bottom left position of said first compartment, a third secondary clasp and fourth secondary clasp located at a bottom right position of said first compartment;

a second compartment having a fifth primary clasp located at a top left position of said second compartment, a sixth primary clasp located at a top right position of said second compartment, a fifth secondary clasp located at a bottom left position of said second compartment, a sixth secondary clasp located at a bottom right position of said second compartment;

a pair of load bearing straps, each said load bearing strap connectable at one end thereof to one of said primary clasps and at another end thereof to one of said secondary clasps, said load bearing straps connectable singularly or together on either said first compartment or said second compartment; and a pair of shoulder tabs formed at a top of said first compartment, said first primary clasp and said second primary clasp being affixed to one of said shoulder tabs and said third primary clasp and said fourth primary clasp being affixed to another of said shoulder tabs.

14. The modular backpack as claimed in claim 13, wherein one of said load bearing straps is connected between said fourth primary clasp and said first secondary clasp.

15. The modular backpack as claimed in claim 13, wherein one of said load bearing straps is connected between said second primary clasp and said third secondary clasp.

16. The modular backpack as claimed in claim 13, wherein one of said load bearing straps is connected between said fifth primary clasp and said sixth secondary clasp.

17. The modular backpack as claimed in claim 13, wherein one of said load bearing straps is connected between said sixth primary clasp and said fifth secondary clasp.

18. The modular backpack as claimed in claim 13, wherein two of said load bearing straps are provided such that one said load bearing strap is connected between said second primary clasp and said first secondary clasp and the other said load bearing strap is connected between said fourth primary clasp and said third secondary clasp.

19. The modular backpack as claimed in claim 13, wherein two of said load bearing straps are provided such that one said load bearing strap is connected between said fifth primary clasp and said fifth secondary clasp and the other said load bearing strap is connected between said sixth primary clasp and said sixth secondary clasp.

20. The modular backpack as claimed in claim 18 wherein said first primary clasp is connected to said fifth primary clasp, said third primary clasp is connected to said sixth primary clasp, said second secondary clasp is connected to said fifth secondary clasp, and said fourth secondary clasp is connected to said sixth secondary clasp.

* * * * *